United States Patent [19]

Noujain

[11] Patent Number: 5,072,512

[45] Date of Patent: Dec. 17, 1991

[54] RESERVOIR RAZOR FOR APPLYING A THIN FILM OF METAL LUBRICANT ONTO THE BLADE OF THE RAZOR AND METHOD OF SHAVING

[76] Inventor: Elie G. Noujain, 912 W. 2nd St., Northfield, Minn. 55057

[21] Appl. No.: 526,042

[22] Filed: May 18, 1990

[51] Int. Cl.[5] ..... B26B 19/40; B26B 19/48

[52] U.S. Cl. ..... 30/41.5; 30/41

[58] Field of Search ..... 30/41, 41.5, 133, 85, 30/86, 90; 222/494, 95, 96

[56] References Cited

U.S. PATENT DOCUMENTS

| | | | |
|---|---|---|---|
| 1,709,460 | 5/1927 | Caseau . | |
| 2,037,588 | 7/1935 | Pica . | |
| 2,327,192 | 5/1943 | Keene . | |
| 2,366,759 | 10/1940 | Bromborough . | |
| 2,705,365 | 10/1951 | Van Heest . | |
| 2,715,767 | 10/1951 | Van Heest . | |
| 2,786,270 | 8/1954 | Orlando et al. . | |
| 3,178,352 | 4/1965 | Erickson . | |
| 3,353,264 | 11/1967 | Waldman . | |
| 3,417,468 | 12/1968 | Miyauchi . | |
| 3,777,597 | 12/1973 | Herb . | |
| 3,818,105 | 6/1974 | Coopersmith . | |
| 4,074,429 | 2/1978 | Roberts . | |
| 4,127,872 | 11/1978 | Shen Lo . | |
| 4,177,556 | 12/1979 | Galli, Jr. . | |
| 4,238,882 | 12/1980 | Harrison, Sr. . | |
| 4,257,160 | 3/1981 | Murai | 30/41 |
| 4,377,034 | 3/1983 | Druash et al. | 30/41 |
| 4,573,266 | 3/1986 | Jacobson | 30/41 |
| 4,653,188 | 3/1987 | Kwak . | |
| 4,753,006 | 6/1988 | Howe . | |
| 4,760,642 | 8/1988 | Kwak . | |
| 4,809,432 | 3/1989 | Schauble . | |
| 4,841,635 | 6/1989 | Maurizi et al. . | |
| 4,850,107 | 7/1989 | Valliades et al. | 30/41 |
| 4,858,314 | 8/1989 | Cunningham | 30/41 |
| 4,868,982 | 9/1989 | McComas | 30/41 |

*Primary Examiner*—Douglas D. Watts
*Assistant Examiner*—Paul M. Heyrana, Sr.
*Attorney, Agent, or Firm*—Merchant, Gould, Smith, Edell, Welter & Schmidt

[57] ABSTRACT

A razor with an internal reservoir containing a supply of a metal lubricant and a method of shaving with the razor which eliminates the need to contact the skin with shaving cream. The razor includes a means for dispensing the metal lubricant directly onto the razor blade(s) so as to provide a thin film of metal lubricant on the exposed surface of the blade(s).

20 Claims, 1 Drawing Sheet

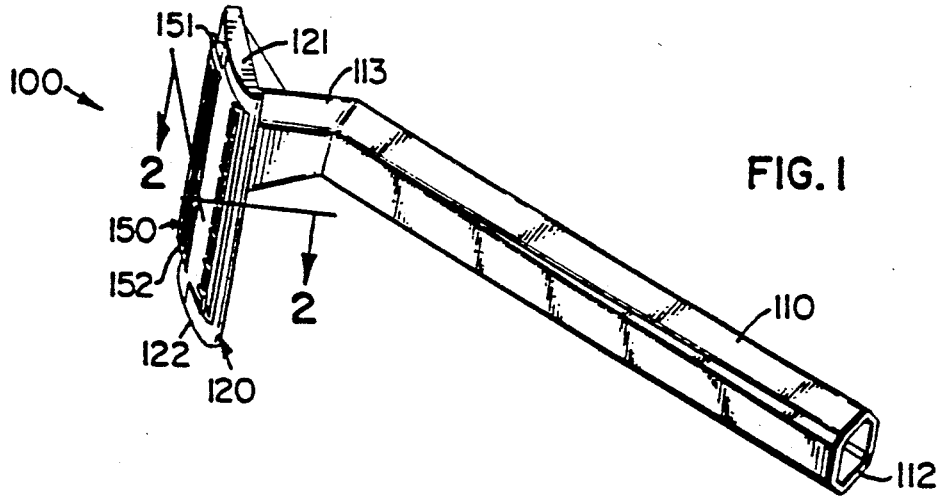
FIG. 1
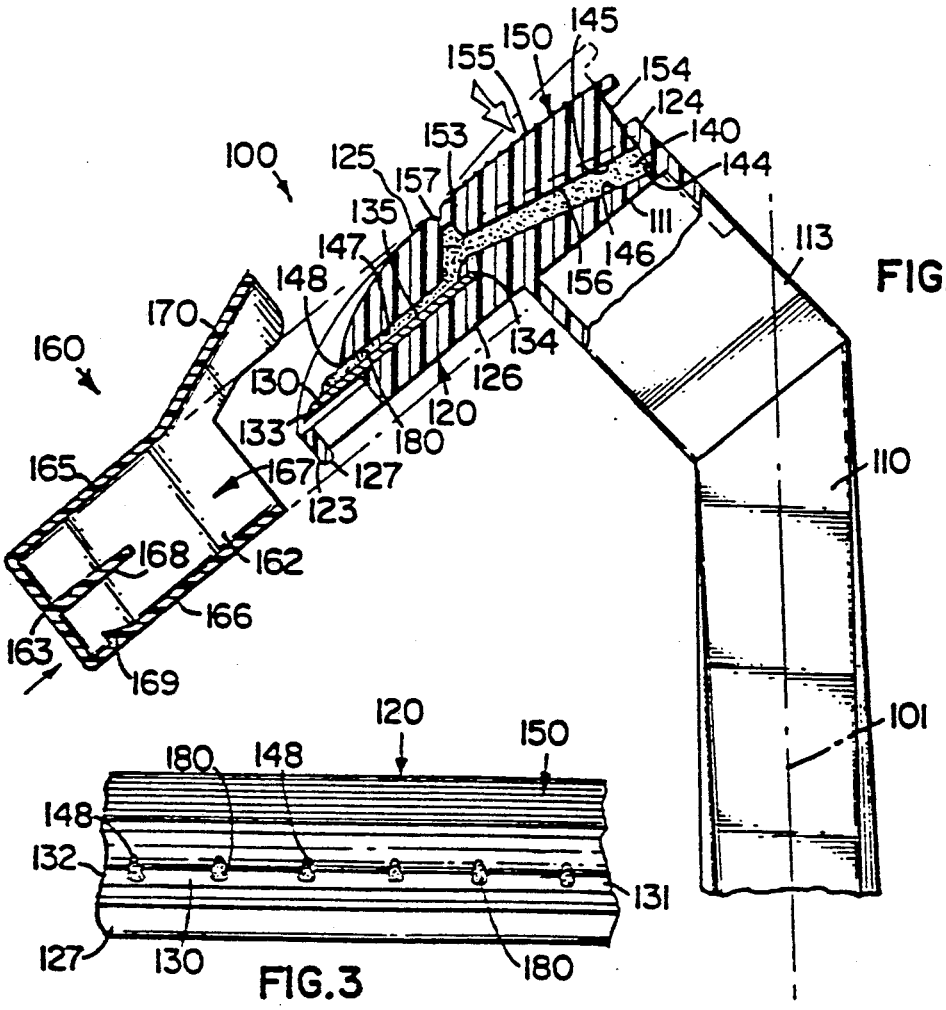
FIG. 2
FIG. 3

RESERVOIR RAZOR FOR APPLYING A THIN FILM OF METAL LUBRICANT ONTO THE BLADE OF THE RAZOR AND METHOD OF SHAVING

FIELD OF THE INVENTION

Broadly, the invention relates to shaving devices. Specifically, the invention relates to disposable razors which include an internal reservoir for retaining a metal lubricant to be dispensed directly onto the blade of the razor.

BACKGROUND OF THE INVENTION

Recent advancements in the area of disposable razors has resulted in an extremely convenient product providing superior performance at a competitive price. One of the conveniences offered by several designs is the inclusion of a supply of shaving cream within the razor.

Maurizi et al., U.S. Pat. No. 4,841,635, describes a razor with a chamber in the handle for retaining a supply of shaving cream. A plunger is provided for forcing the shaving cream from the chamber onto the head of the razor.

Schauble, U.S. Pat. No. 4,809,432, describes a disposable razor having an emollient reservoir within the handle A pressure inducing rubber bulb is provided at the distal end of the handle for forcing emollient from the reservoir directly onto the razor blade.

Howe, U.S. Pat. No. 4,753,006, describes a disposable razor with a chamber in the handle for retaining a supply of shaving cream. The shaving cream is dispensed from the chamber through the distal end of the handle.

Kwak, U.S. Pat. No. 4,653,188, describes a razor with a chamber in the handle for retaining shaving cream. The shaving cream is dispensed from the chamber onto a cotton surface plate on the head of the razor through a plurality of small holes in the head of the razor.

Harrison Sr., U.S. Pat. No. 4,238,882, describes a shaver with a head which defines a reservoir for retaining a supply of shaving cream. The shaving cream flows from the reservoir onto the razor blade through a plurality of small holes immediately underneath the razor blade when the razor blade shivers during normal use.

Because of the substantial amount of shaving cream typically required for a single shaving operation, those razors which include a reservoir for the shaving cream are generally considerably larger than comparative razors which do not include such a reservoir.

The shaving cream dispensed from the reservoir razors is designed to lubricate the skin and therefore must coat the skin prior to shaving in order to be effective. Hence, the dispensing of shaving cream from a reservoir in the razor directly onto the head of the razor during shaving (Maurizi et al., Schauble, Kwak, and Harrison Sr.) does not generally provide effective lubrication because it does not effectively coat the skin prior to shaving. The alternative option of applying the shaving cream from the reservoir onto the skin prior to shaving (Howe) is less convenient because of the additional time and trouble associated with the additional step.

Accordingly, a substantial need exists for a compact disposable razor capable of efficiently providing an effective lubricant directly onto the blade of the razor from an internal reservoir.

SUMMARY OF INVENTION

The invention is directed to a razor with an internal reservoir containing a supply of a metal lubricant. The razor includes a means for dispensing the metal lubricant directly onto the razor blade(s) so as to provide a thin film of metal lubricant on the exposed surface of the blade(s) which will contact the skin during shaving.

The invention is also directed to a convenient yet effective method of shaving which eliminates the need to apply a lubricant to the skin prior to shaving and includes the step of coating the blade of the razor with a thin film of a metal lubricant. The method is conveniently practiced with the disclosed razor.

BRIEF DESCRIPTION OF THE DRAWINGS

FIG. 1 is a perspective view of one embodiment of the invention depicting the shield detached from the razor.

FIG. 2 is a cross-sectional view of the invention depicted in FIG. 1 taken along line 2—2.

FIG. 3 is an enlarged front view of the head portion of the invention depicted in FIG. 1.

DETAILED DESCRIPTION OF THE INVENTION INCLUDING A BEST MODE

Nomenclature

100: razor
101: longitudinal axis of razor
110: handle
111: first end of handle
112: second end of handle
113: angled length of handle
120: head
121: right side of head
122: left side of head
123: front of head
124: back of head
125: top of head
126: bottom of head
127: front flange
130: blade
131: right side of blade
132: left side of blade
133: sharpened front edge of blade
134: back edge of blade
135: upper surface of blade
140: reservoir
144: back wall of reservoir
145: top of reservoir
146: bottom of reservoir
147: channel
148: outlet ports
150: hinged pressure plate
151: right side of pressure plate
152: left side of pressure plate
153: front of pressure plate
154: back of pressure plate
155: top of pressure plate
156: bottom of pressure plate
157: groove
160: shield
162: left side of shield
163: front of shield
165: top of shield
166: bottom of shield
167: receptive channel defined by shield

168: tapered projections
169: inclined tab
170: inclined flange
171: runners
180: metal lubricant

DISCUSSION

Referring to FIGS. 1 and 2, the razor 100 includes a longitudinally elongated handle 110 with a first longitudinal end 111 and a second longitudinal end 112. The handle 110 may be configured to any desired size and shape without affecting the functioning of the razor 100 but is preferably sized to provide a small yet ergonomically designed razor 100.

A head 120 is transversely connected to the first distal end 111 of the handle 110. A length 113 of the handle 110 proximate the first end 111 is angled with respect to the longitudinal axis 101 of the handle 110 in order to offset the head 120 from the handle 110.

A blade 130 extends from the right side 121 to the left side 122 of the head 120 and is securely retained by the head 120 so as to expose a portion of the upper surface 135 and the front sharpened edge 133 of the blade 130. The blade 130 is oriented so that the sharpened edge 133 of the blade 130 is substantially parallel to the front 123 of the head 120.

The head 120 defines an internal reservoir 140 for retaining a supply of a metal lubricant 180. A funneling channel [not shown] extending continuously from proximate the right side 131 to proximate the left side 132 of the blade 130 interconnects the reservoir 140 to a plurality of outlet ports 148 immediately above the upper surface 135 of the blade 130.

A pressure plate 150, continuously formed with the head 120, extends rearwardly from the top 125 of the head 120. The front edge 153 of the pressure plate 150 is separated from the top 125 of the head 120 by a groove 157 which provides for hinged movement of the pressure plate 150 relative to the head 120 about the front edge 153 of the pressure plate 150. The thickness of the pressure plate 150 gradually increases as the pressure plate 150 extends towards the back 124 of the head 120 so that the top 155 of the pressure plate 150 angles upwardly from the head 120 while the bottom 156 of the pressure plate 150 forms the top 145 of the reservoir 140. The pressure plate 150 provides for on-demand dispensing of the metal lubricant 180 from the reservoir 140 onto the blade 130 by simply forcing the pressure plate 150 towards the reservoir 140.

The right side 151, left side 152 and back side 154 of the pressure plate 150 sealingly contact the right side [not shown], left side [not shown] and back wall 144 of the reservoir 140 respectively. Rotation of the pressure plate 150 about the hinged front side 153 into the reservoir 140 places pressure upon the metal lubricant 180 in the reservoir 140 and causes the metal lubricant 180 to flow through the channel 147 and onto the exposed surface of the blade 130 through the outlet ports 148. Location of the pressure plate 150 on the top 125 of the head 120 permits metal lubricant 180 to be dispensed onto the blade 130 by merely angling the razor 100 during use so as to provide contact between the top 155 of the pressure plate 150 and the skin [not shown] and then applying sufficient force against the pressure plate 150 to exert dispensing pressure upon the metal lubricant 180 in the reservoir 140.

The razor 100 is provided with a shield 160 which covers the exposed portions of the blade 130 and plugs the outlet ports 148. The shield 160 defines a receptive channel 167 sized and configured to accept the front portion of the head 120. The top 165 of the shield 160 includes an inclined flange 170 to accommodate the upwardly angled pressure plate 150 and protect the pressure plate 150 from accidental depression. The right [not shown] and left 162 sides of the shield 160 include runners 171 for providing continued contact with the top surface 125 of the head 120 on either side of the pressure plate 150. Tapered projections 168 extend into the receptive channel 167 from the front surface 163 of the shield 160. The projections 168 are configured and arranged to be sealingly wedged into the outlet ports 148 when the shield 160 is coupled to the head 120. The bottom 166 of the shield 160 includes an inwardly and forwardly inclined tab 169 for engaging the downwardly extending front flange 127 on the head 120 and thereby providing resistance to removal the shield 160 from the head 120.

The razor 100 may conveniently be manufactured from molded plastic with the metallic blade 130 coupled to the head 120 by any convenient method.

Dispensing metal lubricant 180 from the reservoir 140 onto the blade 130 so as to provide a thin coating of the lubricant 180 on the blade 130 provides adequate lubrication for smoothly and safely shaving several linear feet of skin. The effectiveness of the metal lubricant 180 provides that the size of the razor 100 need not be increased substantially to accommodate the metal lubricant 180. Generally, the reservoir 140 for nonrefillable multiple use razors 100 should be about 1 $cm^3$ while refillable multiple use and single use disposable razors 100 need retain only about 0.2 to 0.5 $cm^3$ of metal lubricant 180. Accordingly, the head 120 of the razor 100 may typically be sized to less than 5 $cm^3$ with a size of less than about 2 $cm^3$ and frequently less than about 1 $cm^3$ suitable for nonrefillable multiple use razors 100 and a size of less than about 1 $cm^3$ and frequently less than 0.5 $cm^3$ suitable for refillable multiple use and single use disposable razors 100.

The lubricant 180 is a metal lubricant which is formulated to lubricate the exposed surface of the metallic blade 130. Metal lubricants are a well known class of lubricants which are generally based upon silicone and employed during the cold processing of metals.

Additional components may be combined with the lubricant 180 to achieve a desired effect such as scents, perfumes, dyes and the like.

The razor 100 is functional even when submerged so as to permit shaving while showering or bathing. The lubricant 180 is not readily water soluble and will remain on a submerged blade 130 for a time period sufficient to effectuate shaving.

The specification is intended to aid in the complete non-limiting understanding of the invention. Since many variations and embodiments of the invention may be designed without departing from the spirit and scope of the invention, the scope of the invention which we wish to protect resides in the claims hereinafter appended.

I claim:

1. A razor, comprising (a) a head, (b) a blade coupled to the head, the blade having a front sharpened edge, (c) a reservoir, (d) a supply of a metal lubricant retained within the reservoir, and (e) a funneling channel, the funneling channel being in fluid communication with the reservoir, the funneling channel having an outlet sidewall, the funneling channel having a bottom surface formed by the blade;

(f) a plurality of funneling channel outlet ports, the funneling channel outlet ports being formed within and passing through the funneling channel outlet sidewall, the outlet ports above the blade having a perimeter, a portion of the perimeter being formed to hold the blade in position;

(g) a hinged pressure plate for dispensing the metal lubricant across the blade from the reservoir and through the funneling channel outlet ports, thereby reaching the front sharpened edge of the blade.

2. The razor of claim 1 further comprising a handle coupled to the head.

3. The razor of claim 1 further comprising a shield removably coupled to the head for protectively covering the blade and including a means for preventing the release of metal lubricant onto the blade when the shield is coupled to the head.

4. The razor of claim 1 wherein the reservoir is completely within the head of the razor and the head is less than about 5 $cm^3$.

5. The razor of claim 1 wherein the reservoir is less than about 2 $cm^3$.

6. The razor of claim 1 wherein the reservoir is less than about 1 $cm^3$.

7. The razor of claim 1 wherein the reservoir is less than about 0.5 $cm^3$.

8. The razor of claim 1 wherein the metal lubricant is a silicone-based lubricant.

9. The razor of claim 8 wherein the reservoir contains less than about 1 $cm^3$ lubricant.

10. The razor of claim 8 wherein the reservoir contains less than about 0.5 $cm^3$ lubricant.

11. The razor of claim 1 wherein the means for dispensing metal lubricant from the reservoir directly onto the blade is a plurality of outlet ports proximate an upper surface of the blade and a pressure plate for placing the metal lubricant under pressure when depressed.

12. The razor of claim 11 further comprising a shield removably coupled to the head for protectively covering the blade and including a plurality of tapered projections configured and arranged for plugging the outlet ports when the shield is coupled to the head.

13. A disposable razor, comprising:

(a) a longitudinally extending handle having a first end and a second end, (b) a head transversely coupled to the first end of the handle, (c) a blade coupled to the head so as to expose at least a portion of an upper surface and a sharpened edge of the blade, (d) a completely enclosed reservoir within the head having outlet ports above the blade, the outlet ports having a perimeter, a portion of the perimeter being formed to hold the blade in position;

(e) a supply of metal lubricant retained within the reservoir, (f) a hinged pressure plate for dispensing the metal lubricant across the blade and outwardly from the reservoir, through the outlet ports and continuing along the upper surface of the blade, and (g) a shield removably coupled to the head for protectively covering the blade and including a means for preventing the release of metal lubricant through the outlet ports in the reservoir when the shield is coupled to the head.

14. The razor of claim 13 wherein the reservoir is less than about 1 $cm^3$.

15. The razor of claim 13 wherein the metal lubricant is a silicone-based lubricant.

16. The razor of claim 15 wherein the reservoir contains less than about 1 $cm^3$ lubricant.

17. The razor of claim 15 wherein the reservoir contains less than about 0.5 $cm^3$ lubricant.

18. The razor of claim 13 wherein the means for preventing the release of metal lubricant through the outlet ports comprises a plurality of tapered projections extending from the shield which are configured and arranged for plugging the outlet ports when the shield is coupled to the head.

19. A method of comfortably shaving with a razor blade without applying a lubricating cream to the skin prior to shaving, including the steps of:

(a) forming a lubricant reservoir having at least one boundary defined by the razor blade, (b) forming outlet ports above the blade such that the outlet ports have a perimeter;

(c) forming a portion of the perimeter so as to hold the blade in position; and (d) applying pressure to a hinged pressure plate, thereby ejecting from the reservoir and across the blade a thin film of the metal lubricant.

20. The method of claim 19 wherein the step of applying pressure to a hinged pressure plate, thereby ejecting across the blade a thin film of a metal lubricant, comprises the step of dispensing metal lubricant from a reservoir in response to rotating the blade with respect to the skin.

* * * * *